US010961665B2

(12) United States Patent
Singleton et al.

(10) Patent No.: US 10,961,665 B2
(45) Date of Patent: Mar. 30, 2021

(54) RAIL JOINT ASSEMBLY HAVING FORGED RAIL JOINT BARS

(71) Applicant: Koppers Delaware, Inc., Wilmington, DE (US)

(72) Inventors: Steven D. Singleton, Sarver, PA (US); William Thomas Urmson, Jr., Valencia, PA (US); John W. Mospan, Pittsburgh, PA (US); Ronald K. Junk, Cabot, PA (US); Donald A. Bielski, Youngstown, OH (US)

(73) Assignee: Koppers Delaware, Inc., Wilmington, DE (US)

( * ) Notice: Subject to any disclaimer, the term of this patent is extended or adjusted under 35 U.S.C. 154(b) by 226 days.

(21) Appl. No.: 16/173,370

(22) Filed: Oct. 29, 2018

(65) Prior Publication Data

US 2019/0127923 A1 May 2, 2019

Related U.S. Application Data

(60) Provisional application No. 62/579,333, filed on Oct. 31, 2017.

(51) Int. Cl.
*E01B 11/54* (2006.01)
*E01B 11/08* (2006.01)

(52) U.S. Cl.
CPC ..... *E01B 11/54* (2013.01); *E01B 11/08* (2013.01); *E01B 2201/04* (2013.01); *E01B 2205/00* (2013.01)

(58) Field of Classification Search
CPC ..... E01B 11/08; E01B 11/10; E01B 11/54; E01B 9/60; E01B 2201/04; E01B 2205/00; B60M 5/00
See application file for complete search history.

(56) References Cited

U.S. PATENT DOCUMENTS 4,464,831 A * 8/1984 Weber ..... E01B 11/44 156/381
4,630,772 A * 12/1986 Watanabe ..... E01B 11/54 219/545
5,503,331 A * 4/1996 Uramson, Jr. ..... E01B 11/10 238/152

(Continued)

FOREIGN PATENT DOCUMENTS

EP 2243880 A2 10/2010
WO 03048456 A1 6/2003

*Primary Examiner* — Jason C Smith
(74) *Attorney, Agent, or Firm* — The Webb Law Firm

(57) ABSTRACT

A rail joint bar includes a body having a first end, a second end positioned opposite from the first end, a first side, a second side positioned opposite from the first side, a top portion positioned between the first and second sides, and a bottom portion positioned between the first and second sides and positioned opposite from the top portion. The body having a first section adjacent to the first end of the body, a second section adjacent to the second end of the body, and an intermediate section positioned between the first section and the second section. The second side of the body includes a first protrusion and a second protrusion spaced from the first protrusion, with a width of the first protrusion at the intermediate section of the body larger than a width of the first protrusion at the first and second sections of the body.

22 Claims, 5 Drawing Sheets

(56) References Cited

U.S. PATENT DOCUMENTS

| | | | | |
|---|---|---|---|---|
| D497,326 | S * | 10/2004 | Urmson, Jr. | D12/51 |
| 7,090,143 | B2 * | 8/2006 | Urmson, Jr. | E01B 11/04 238/152 |
| 7,097,112 | B2 * | 8/2006 | Urmson, Jr. | E01B 11/04 238/125 |
| 7,490,781 | B2 | 2/2009 | Urmson, Jr. et al. | |
| 7,677,466 | B2 | 3/2010 | Click et al. | |
| 7,975,933 | B2 * | 7/2011 | Urmson, Jr. | E01B 11/54 238/152 |
| 8,113,441 | B2 * | 2/2012 | Urmson, Jr. | E01B 11/54 238/153 |
| 8,123,144 | B2 | 2/2012 | Urmson, Jr. et al. | |
| 8,133,441 | B2 * | 3/2012 | He | B01J 19/10 422/128 |
| 8,302,878 | B2 | 11/2012 | Urmson, Jr. et al. | |
| 8,777,121 | B2 | 7/2014 | Urmson, Jr. et al. | |
| 9,328,464 | B2 * | 5/2016 | Urmson, Jr. | E01B 5/02 |
| 2007/0272762 | A1 * | 11/2007 | Click | E01B 11/54 238/14.05 |
| 2018/0119362 | A1 * | 5/2018 | Urmson, Jr. | E01B 11/54 |
| 2019/0127923 | A1 * | 5/2019 | Singleton | E01B 11/08 |

* cited by examiner

RAIL JOINT ASSEMBLY HAVING FORGED RAIL JOINT BARS

CROSS-REFERENCE TO RELATED APPLICATION

This application claims priority to U.S. Provisional Application Ser. No. 62/579,333, filed Oct. 31, 2017, which is hereby incorporated by reference in its entirety.

BACKGROUND OF THE INVENTION

Field of the Invention

The present invention relates to a rail joint assembly and, more particularly, to an insulated rail joint assembly.

Description of Related Art

A rail system, which permits more than one train to travel on one stretch of track of rail, is generally divided into sections or blocks. The purpose of dividing railroad rails of a rail system into sections is to detect the presence of a train on a section of rail at any given time. Each rail section is electrically isolated from all other sections so that a high electrical resistance can be measured over the rail section when no train is present in that section. When a train enters a rail section, the train will short circuit adjacent railroad rails in which the electrical resistance in the rail section drops, thereby indicating the presence of a train.

Railroad rails are generally welded to each other or attached to each other by steel rail joint bars. There are many different types and shapes of rail joint bars. Conventional rail joint bars typically include a body having a front surface and a back surface and define a head section, a web section, and a base section. The web section defines a plurality of holes for receiving fasteners to secure the rail joint bar to the abutting rails. High-performance, non-metallic rail joint bars are typically used for electrically-isolating adjacent rail sections of a rail system in order to create an electrically-isolated section. An alternative to the non-metallic rail joint bar is a steel rail joint bar having electrically-insulating material and an adhesive, such as epoxy, bonded to the back surface of the rail joint bar.

SUMMARY OF THE INVENTION

In one aspect, a rail joint bar includes a body having a first end, a second end positioned opposite from the first end, a first side, a second side positioned opposite from the first side, a top portion positioned between the first and second sides, and a bottom portion positioned between the first and second sides and positioned opposite from the top portion. The body having a first section adjacent to the first end of the body, a second section adjacent to the second end of the body, and an intermediate section positioned between the first section and the second section. The second side of the body includes a first protrusion and a second protrusion spaced from the first protrusion, with the first and second protrusions each having a length defined by an axis extending from the first end of the body to the second end of the body, a width defined by an axis extending from the first side of the body to the second side of the body, and a height defined by an axis extending from the top portion to the bottom portion of the body. The width of the first protrusion at the intermediate section of the body is larger than the width of the first protrusion at the first and second sections of the body.

The width of the second protrusion at the intermediate section of the body may be larger than the width of the second protrusion at the first and second sections of the body. The length of the first and second protrusions may extend from the first end of the body to the second end of the body. The first and second protrusions may define a recessed area between the first and second protrusions.

The height of the first protrusion at the intermediate section of the body may be larger than the height of the first protrusion at the first and second sections of the body. The height of the second protrusion at the intermediate section of the body may be larger than the height of the second protrusion at the first and second sections of the body.

The first protrusion at the intermediate section of the body may include a first tapered portion, a middle portion, and a second tapered portion, with the first tapered portion of the first protrusion increasing in width from the first section of the body to the middle portion of the first protrusion, and the second tapered portion of the first protrusion increasing in width from the second section of the body to the middle portion of the first protrusion. The middle portion of the first protrusion at the intermediate section of the body may be a constant width.

The second protrusion at the intermediate section of the body may include a first tapered portion, a middle portion, and a second tapered portion, with the first tapered portion of the second protrusion increasing in width from the first section of the body to the middle portion of the second protrusion, and the second tapered portion of the second protrusion increasing in width from the second section of the body to the middle portion of the second protrusion. The middle portion of the second protrusion at the intermediate section of the body may be a constant width.

The first protrusion may be spaced from the top portion of the body. The second protrusion may define a part of the bottom portion of the body. The body may define a plurality of openings, each configured to receive a fastener. The body may be manufactured via a forging process.

In a further aspect, a rail joint assembly includes a first rail having a head portion, a web portion, and a base portion, with the first rail having a first side and a second side, a second rail having a head portion, a web portion, and a base portion, with the second rail having a first side and a second side. An end of the first rail is configured to abut an end of the second rail. The assembly further includes a first rail joint bar comprising a body having a first end, a second end positioned opposite from the first end, a first side, a second side positioned opposite from the first side, a top portion positioned between the first and second sides, and a bottom portion positioned between the first and second sides and positioned opposite from the top portion. The body has a first section adjacent to the first end of the body, a second section adjacent to the second end of the body, and an intermediate section positioned between the first section and the second section. The assembly also includes a second rail joint bar having a body having a first end, a second end positioned opposite from the first end, a first side, a second side positioned opposite from the first side, a top portion positioned between the first and second sides, and a bottom portion positioned between the first and second sides and positioned opposite from the top portion. The body having a first section adjacent to the first end of the body, a second section adjacent to the second end of the body, and an intermediate section positioned between the first section and the second section. The second side of the body of the first and second rail joint bars each include a first protrusion and a second protrusion spaced from the first protrusion, with the first and second protrusions each having a length defined by an axis extending from the first end of the body to the second end of the body, a width defined by an axis extending from the first side of the body to the second side of the body, and a height defined by an axis extending from the top portion to the bottom portion of the body. The width of the first protrusion at the intermediate section of the body is larger than the width of the first protrusion at the first and second sections of the body, with the first rail joint bar configured to abut the first sides of the first and second rails with the intermediate section of the first rail joint bar overlapping the ends of the first and second rails in a direction extending along a longitudinal axis of the first and second rails. The second rail joint bar is configured to abut second sides of the first and second rails with the intermediate section of the second rail joint bar overlapping the ends of the first and second rails in a direction extending along a longitudinal axis of the first and second rails.

The width of the second protrusion of the first and second rail joint bars at the intermediate section of each body may be larger than the width of the second protrusion of the first and second rail joint bars at the first and second sections of each body. The height of the first protrusion of the first and second rail joint bars at the intermediate section of each body may be larger than the height of the first protrusion of the first and second rail joint bars at the first and second sections of each body. The height of the second protrusion of the first and second rail joint bars at the intermediate section of each body may be larger than the height of the second protrusion of the first and second rail joint bars at the first and second sections of each body.

The first protrusion of the first and second rail joint bars at the intermediate section of each body may include a first tapered portion, a middle portion, and a second tapered portion, with the first tapered portion of each first protrusion increasing in width from the first section of each body to the middle portion of each first protrusion, and the second tapered portion of each first protrusion of the first and second rail joint bars increasing in width from the second section of each body to the middle portion of each first protrusion. The second protrusion of the first and second rail joint bars at the intermediate section of each body may include a first tapered portion, a middle portion, and a second tapered portion, with the first tapered portion of each second protrusion increasing in width from the first section of each body to the middle portion of each second protrusion, and the second tapered portion of each second protrusion increasing in width from the second section of each body to the middle portion of each second protrusion.

The rail joint assembly may further include a plurality of fasteners configured to secure the first and second rail joint bars to the first and second rails, with the body of the first and second rail joint bars each defining a plurality of openings each configured to receive one of the plurality of fasteners.

The rail joint assembly may further include a first insulator configured to be positioned between the first rail joint bar and the first and second rails and a second insulator configured to be positioned between the second rail joint bar and the first and second rails. The body may be manufactured via a forging process.

In another aspect, a method of manufacturing a rail joint bar includes providing a metal body having a first end, a second end positioned opposite from the first end, a first side, a second side positioned opposite from the first side, a top portion positioned between the first and second sides, and a bottom portion positioned between the first and second sides and positioned opposite from the top portion, with the body having a first section adjacent to the first end of the body, a second section adjacent to the second end of the body, and an intermediate section positioned between the first section and the second section. The method further includes forming a first protrusion and a second protrusion spaced from the first protrusion on the second side of the body via a forging process. The first and second protrusions each having a length defined by an axis extending from the first end of the body to the second end of the body, a width defined by an axis extending from the first side of the body to the second side of the body, and a height defined by an axis extending from the top portion to the bottom portion of the body, with the width of the first protrusion at the intermediate section of the body being larger than the width of the first protrusion at the first and second sections of the body.

DETAILED DESCRIPTION OF THE INVENTION

Figure 1:
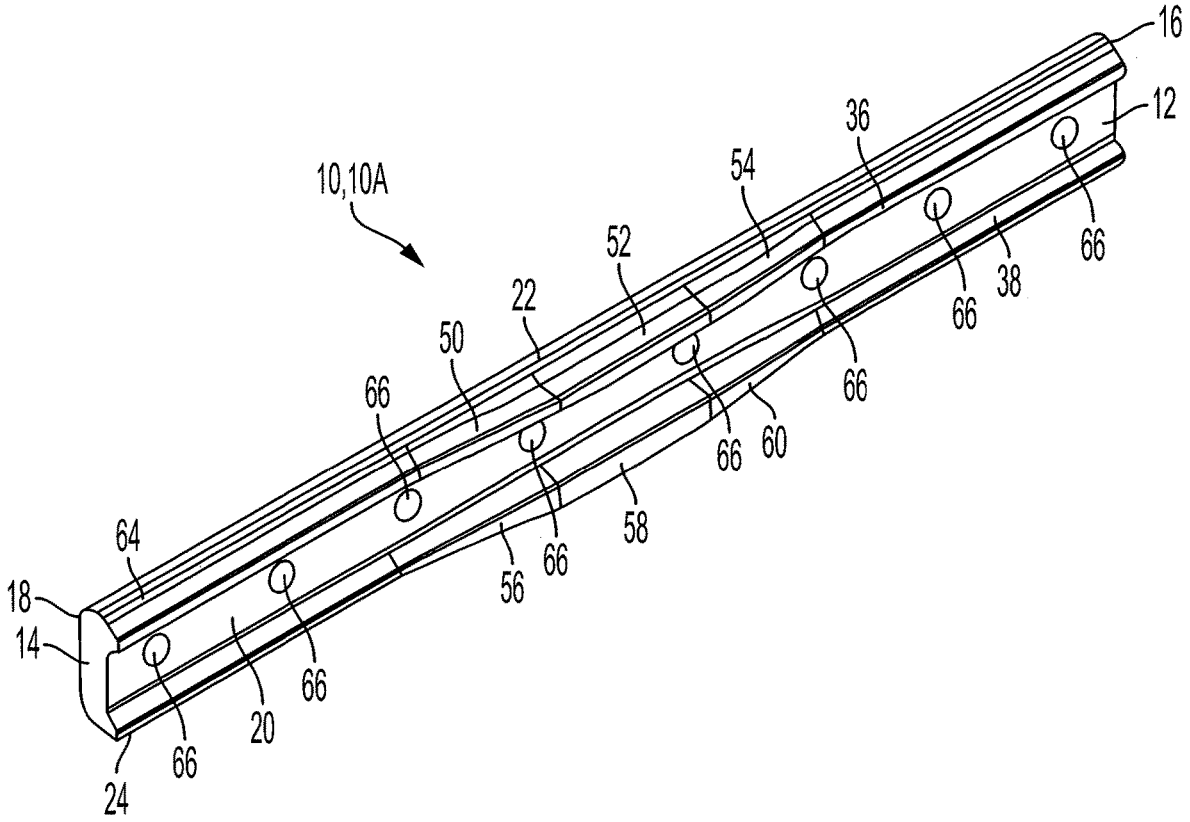
FIG. 1 is a perspective view of a rail joint bar according to one aspect of the present invention.

For purposes of the description hereinafter, the terms "end," "upper," "lower," "right," "left," "vertical," "horizontal," "top," "bottom," "lateral," "longitudinal," and derivatives thereof shall relate to the example(s) as oriented in the drawing figures. However, it is to be understood that the example(s) may assume various alternative variations and step sequences, except where expressly specified to the contrary. It is also to be understood that the specific example (s) illustrated in the attached drawings, and described in the following specification, are simply exemplary embodiments or aspects of the invention. Hence, specific dimensions and other physical characteristics related to the embodiments or aspects disclosed herein are not to be considered as limiting.

Figure 2:
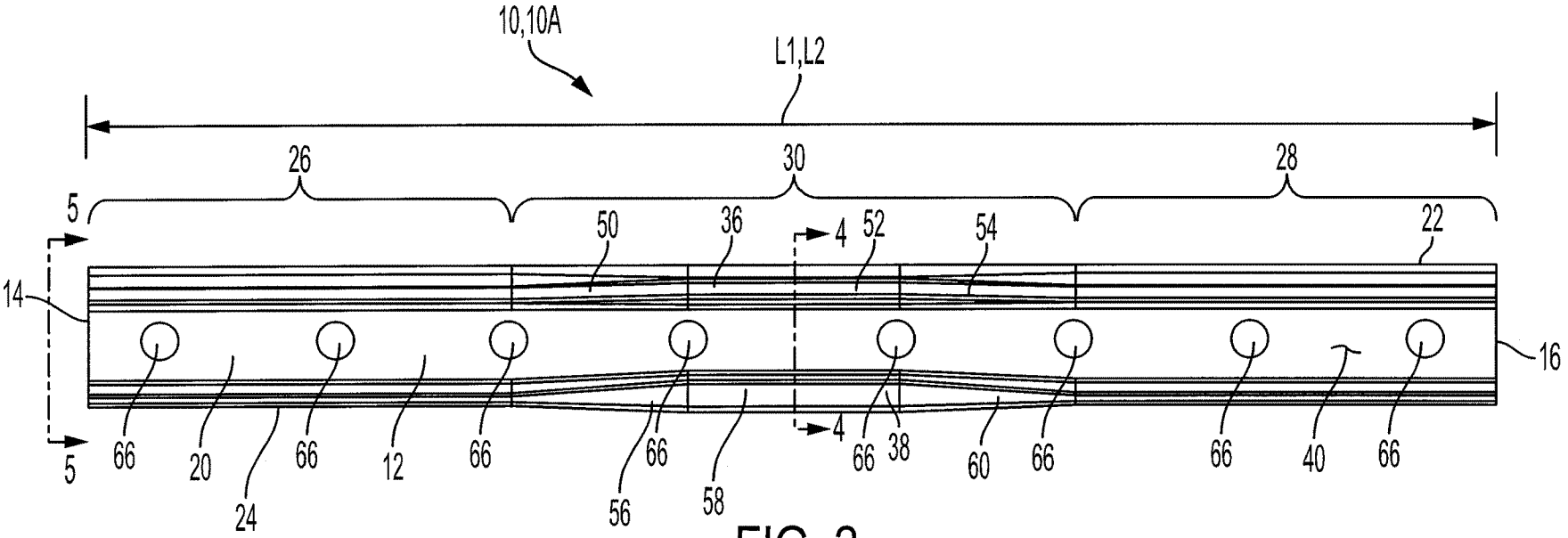
FIG. 2 is a front view of the rail joint bar of FIG. 1.
Figure 3:
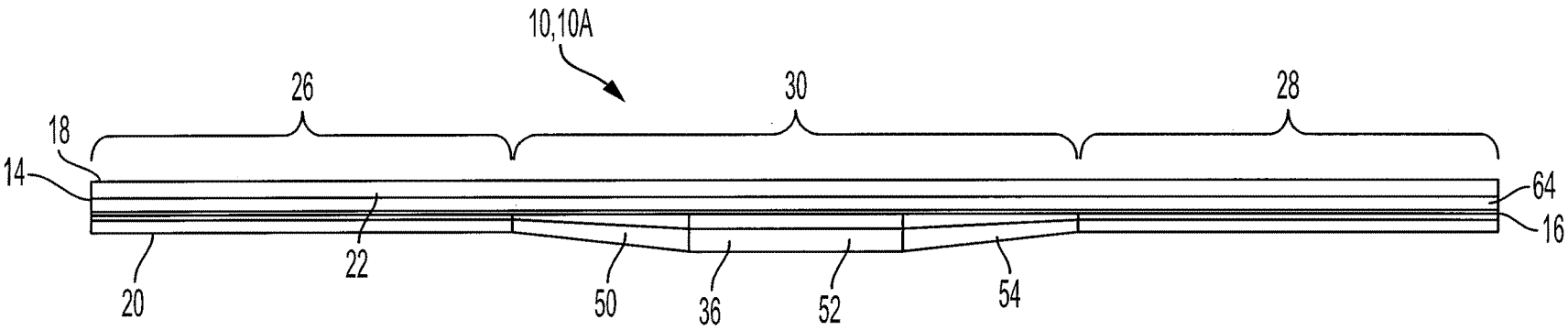
FIG. 3 is a top view of the rail joint bar of FIG. 1.
Figure 5:
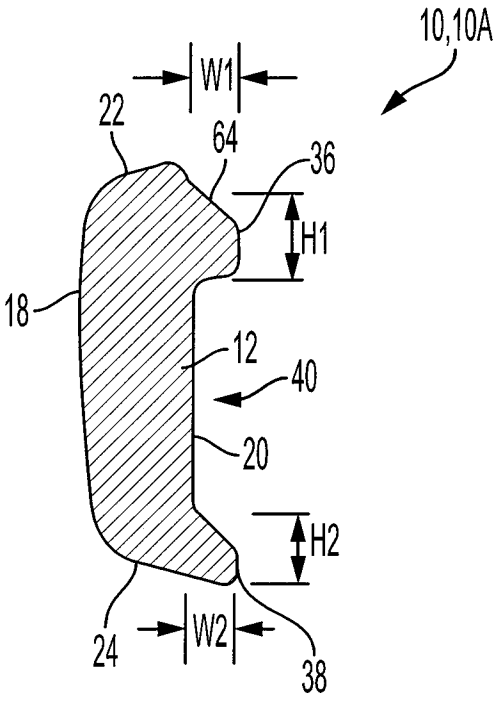
FIG. 5 is a cross-sectional view taken along line 5-5 in FIG. 2.
Figure 4:
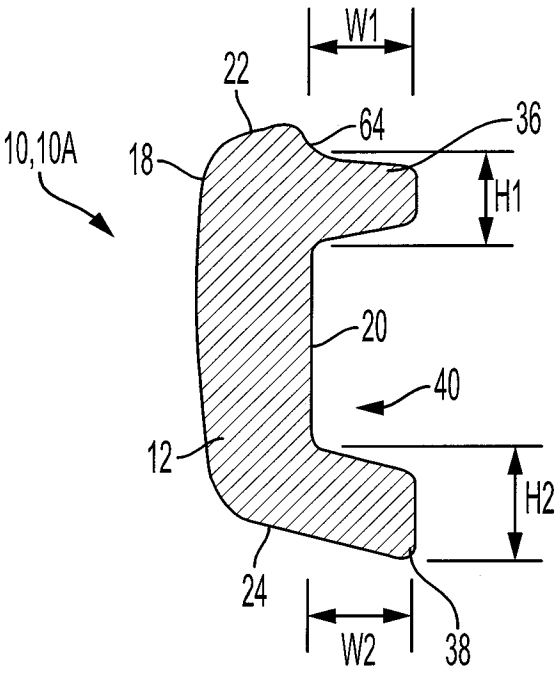
FIG. 4 is a cross-sectional view taken along line 4-4 in FIG. 2.

Referring to FIGS. 1-5, according to one aspect, a rail joint bar 10 includes a body 12 having a first end 14, a second end 16 positioned opposite from the first end 14, a first side 18, a second side 20 positioned opposite from the first side 18, a top portion 22 positioned between the first and second ends 14, 16, and a bottom portion 24 positioned between the first and second sides 18, 20 and positioned opposite from the top portion 22. The body 12 has a first section 26 adjacent to the first end 14 of the body 12, a second section 28 adjacent to the second end 16 of the body 12, and an intermediate section 30 positioned between the first section 26 and the second section 28 as shown in FIGS. 2 and 3. The second side 20 of the body 12 includes a first protrusion 36 and a second protrusion 38 spaced from the first protrusion 36, with the first and second protrusions 36, 38 each having a length L1, L2 defined by an axis extending from the first end 14 of the body 12 to the second end 16 of the body 12, a width W1, W2 defined by an axis extending from the first side 14 of the body 12 to the second side 16 of the body 12, and a height H1, H2 defined by an axis extending from the top portion 22 to the bottom portion 24 of the body 12. The width W1 of the first protrusion 36 at the intermediate section 30 of the body 12 is larger than the width W1 of the first protrusion 36 at the first and second sections 26, 28 of the body 12. Further, the width W2 of the second protrusion 38 at the intermediate section 30 of the body 12 is larger than the width W2 of the second protrusion 38 at the first and second sections 26, 28 of the body 12. The length L1, L2 of the first and second protrusions 36, 38 extends from the first end 14 of the body 12 to the second end 16 of the body 12, although other suitable lengths may be provided. The first and second protrusions 36, 38 define a recessed area 40 between the first and second protrusions 36, 38.

Referring again to FIGS. 1-5, the height H1 of the first protrusion 36 at the intermediate section 30 of the body 12 is larger than the height H1 of the first protrusion 36 at the first and second sections 26, 28 of the body 12. Further, the height H2 of the second protrusion 38 at the intermediate section 30 of the body 12 is larger than the height H2 of the second protrusion 38 at the first and second sections 26, 28 of the body 12. The first protrusion 36 at the intermediate section 30 of the body 12 includes a first tapered portion 50, a middle portion 52, and a second tapered portion 54, with the first tapered portion 50 of the first protrusion 36 increasing in width W1 and height H1 from the first section 26 of the body 12 to the middle portion 52 of the first protrusion 36, and the second tapered portion 54 of the first protrusion 36 increasing in width W1 and height H1 from the second section 28 of the body 12 to the middle portion 52 of the first protrusion 36. The middle portion 52 of the first protrusion 36 at the intermediate section 30 of the body 12 is a constant width W1 and constant height H1. The second protrusion 38 at the intermediate section 30 of the body 12 also includes a first tapered portion 56, a middle portion 58, and a second tapered portion 60, with the first tapered portion 56 of the second protrusion 38 increasing in width W2 and height H2 from the first section 26 of the body 12 to the middle portion 58 of the second protrusion 38, and the second tapered portion 60 of the second protrusion 38 increasing in width W2 and height H2 from the second section 28 of the body 12 to the middle portion 58 of the second protrusion 38. The middle portion 58 of the second protrusion 38 at the intermediate section 30 of the body 12 is a constant width W2 and constant height H2.

Referring to FIGS. 1, 2, 4, and 5, the first protrusion 36 is spaced from the top portion 22 of the body 12 to define a radiused portion 64 between the top portion 22 and the first protrusion 36. The first protrusion 36 extends outwardly and about perpendicular to the second side 20 of the body 12. The second protrusion 38 defines a part of the bottom portion 24 of the body 12. The second protrusion 38 extends outwardly away from the second side 20 of the body 12 and away from the bottom portion 24 of the body 12. The second protrusion 38 may extend at an angle of 100-150 degrees from the second side 20 of the body 12, although other suitable angles may be utilized.

Referring to FIGS. 1 and 2, the body 12 defines a plurality of openings 66 each configured to receive a fastener. As discussed in more detail below, the body 12 is configured to be secured to and abut a pair of railroad rails with the top portion 22 configured to engage a head portion of the rails, the first side 18 configured to engage a web portion of the rails, and the bottom portion 24 configured to engage a base portion of the rails.

The rail joint bar 10 may be manufactured from metal, such as steel, although other suitable materials may be utilized. The rail joint bar 10 may be manufactured via a forging process, such as a hot forging process, although other suitable manufacturing processes, such as casting, machining, roll forming etc. may be utilized. Manufacturing the rail joint bar 10 using a forging process may provide the rail joint bar 10 with improved strength properties compared to a similar rail joint bar manufactured through a casting, machining, or roll forming process. The first and second protrusions 36, 38 are formed integrally with the body 12, although the first and second protrusions 36, 38 may also be formed separately and may be secured to the body 12.

Figure 6:
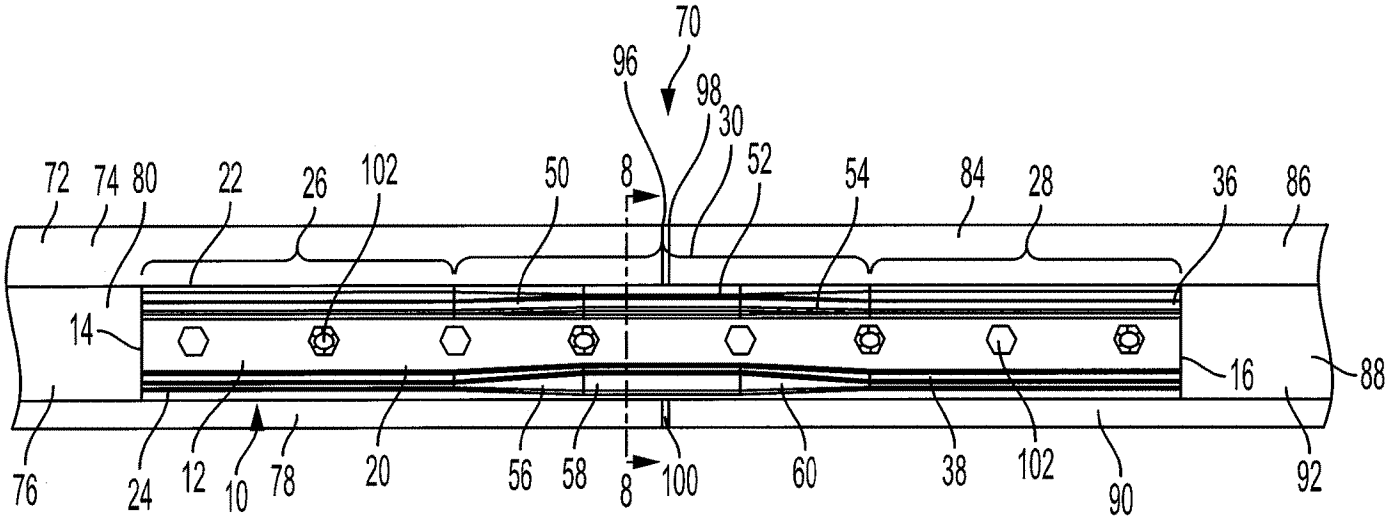
FIG. 6 is a front view of a rail joint assembly according to a further aspect of the present invention.
Figure 7:
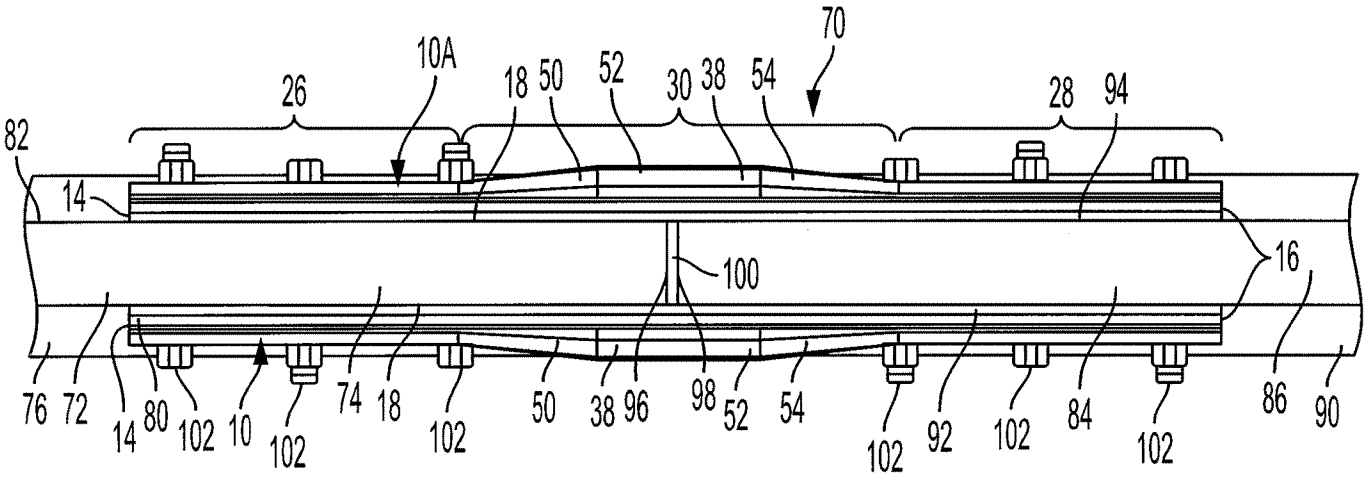
FIG. 7 is a top view of the rail joint assembly of FIG. 6.
Figure 8:
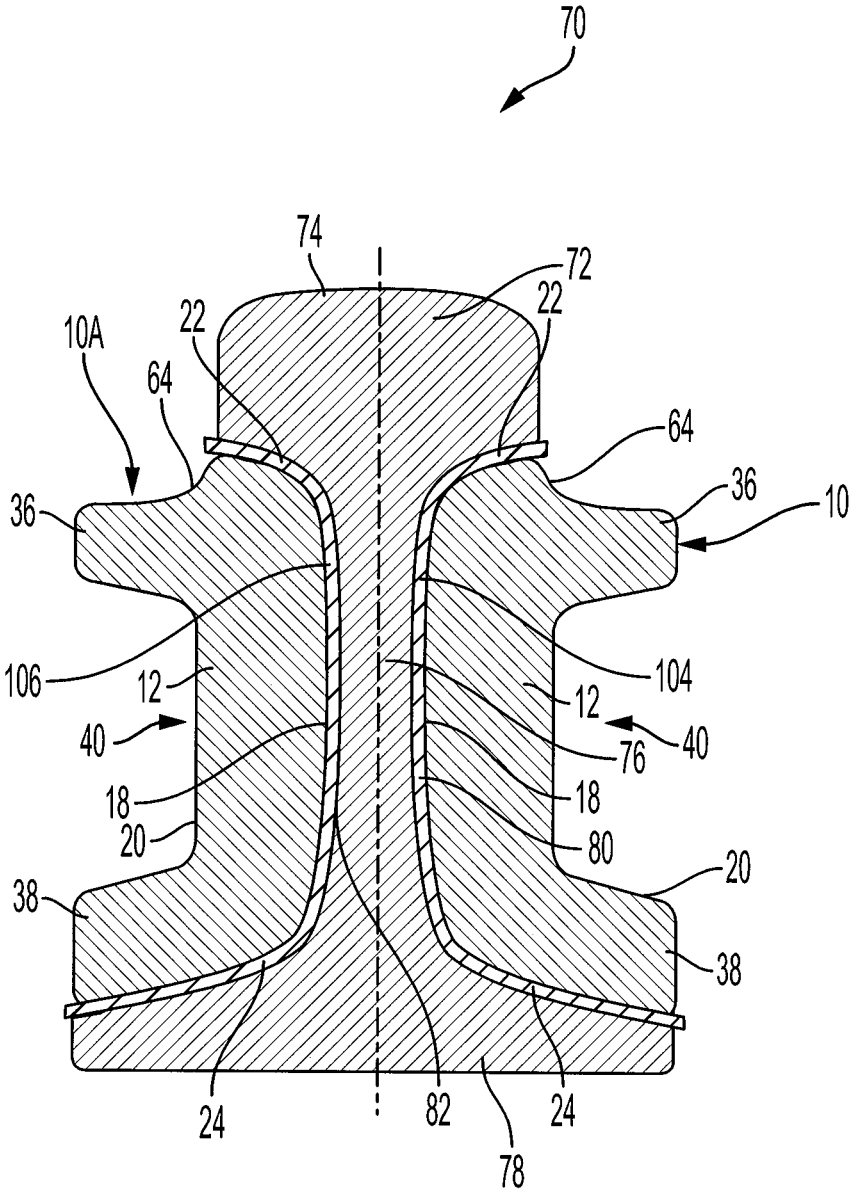
FIG. 8 is a cross-sectional view taken along line 8-8 in FIG. 6.

Referring to FIGS. 6-8, a rail joint assembly 70 utilizing the rail joint bar 10 of FIGS. 1-5 is shown. The rail joint assembly 70 includes a first rail 72 having a head portion 74, a web portion 76, and a base portion 78, with the first rail 72 having a first side 80 and a second side 82. The assembly further includes a second rail 84 having a head portion 86, a web portion 88, and a base portion 90, with the second rail 84 having a first side 92 and a second side 94. An end 96 of the first rail 72 configured to abut an end 98 of the second rail 84. An end post 100 is positioned between the ends 96, 98 of the first and second rails 72, 84 with the end post 100 configured to electrically isolate the first rail 72 from the second rail 84. The rail joint assembly 70 includes a first rail joint bar 10 and a second rail joint bar 10A. The first rail joint bar 10 abuts the first sides 80, 92 of the first and second rails 72, 84 with the intermediate section 30 of the first rail joint bar 10 overlapping the ends 96, 98 of the first and second rails 72, 84 in a direction extending along a longitudinal axis of the first and second rails 72, 84. The second rail joint bar 10A abuts the second sides 82, 94 of the first and second rails 72, 84 with the intermediate section 30 of the second rail joint bar 10A overlapping the ends 96, 98 of the first and second rails 72, 84 in a direction extending along a longitudinal axis of the first and second rails 72, 84.

Referring to FIGS. 6 and 7, the assembly 70 further includes a plurality of fasteners 102 configured to secure the first and second rail joint bars 10, 10A to the first and second rails 72, 84, with the plurality of openings 66 of the first and second rail joint bars 10, 10A each receiving one of the plurality of fasteners 102. The plurality of fasteners 102 may be a nut and bolt arrangement, although other suitable fasteners may be utilized.

Referring to FIG. 8, the assembly 70 also includes a first insulator 104 positioned between the first rail joint bar 10 and the first and second rails 72, 84 and a second insulator 106 positioned between the second rail joint bar 10A and the first and second rails 72, 84. The first and second insulators 104, 106 are configured to electrically isolate the first and second rail joint bars 10, 10A from the first and second rails 72, 84. The first and second insulators 104, 106 may be made from fiberglass, para-aramid synthetic fiber, or any other suitable material.

As shown in FIGS. 6 and 7, the portion of the first and second protrusions 36, 38 of the first and second rail joint bars 10, 10A having the largest width W1, W2 and height H1, H2 are positioned adjacent to where the ends 96, 98 of the first and second rails 72, 84 abut. Providing the first and second protrusions 36, 38, as described above, increases the strength of the first and second rail joint bars 10, 10A at the intermediate section 30 of the joint bars 10, 10A where the joint bars 10, 10A typically experience the largest forces during loading, i.e., passing of a trail along the rail joint assembly 70.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A rail joint bar comprising:

a body having a first end, a second end positioned opposite from the first end, a first side, a second side positioned opposite from the first side, a top portion positioned between the first and second sides, and a bottom portion positioned between the first and second sides and positioned opposite from the top portion, the body having a first section adjacent to the first end of the body, a second section adjacent to the second end of the body, and an intermediate section positioned between the first section and the second section, wherein the second side of the body includes a first protrusion and a second protrusion spaced from the first protrusion, the first and second protrusions each having a length defined by an axis extending from the first end of the body to the second end of the body, a width defined by an axis extending from the first side of the body to the second side of the body, and a height defined by an axis extending from the top portion to the bottom portion of the body, the width of the first protrusion at the intermediate section of the body is larger than the width of the first protrusion at the first and second sections of the body, and wherein the length of the first and second protrusions extends from the first end of the body to the second end of the body.

2. The rail joint bar of claim 1, wherein the width of the second protrusion at the intermediate section of the body is larger than the width of the second protrusion at the first and second sections of the body.

3. The rail joint bar of claim 2, wherein the first and second protrusions define a recessed area between the first and second protrusions.

4. The rail joint bar of claim 2, wherein the second protrusion at the intermediate section of the body includes a first tapered portion, a middle portion, and a second tapered portion, the first tapered portion of the second protrusion increasing in width from the first section of the body to the middle portion of the second protrusion, the second tapered portion of the second protrusion increasing in width from the second section of the body to the middle portion of the second protrusion.

5. The rail joint bar of claim 4, wherein the middle portion of the second protrusion at the intermediate section of the body is a constant width.

6. The rail joint bar of claim 1, wherein the height of the first protrusion at the intermediate section of the body is larger than the height of the first protrusion at the first and second sections of the body.

7. The rail joint bar of claim 6, wherein the height of the second protrusion at the intermediate section of the body is larger than the height of the second protrusion at the first and second sections of the body.

8. The rail joint bar of claim 1, wherein the first protrusion at the intermediate section of the body includes a first tapered portion, a middle portion, and a second tapered portion, the first tapered portion of the first protrusion increasing in width from the first section of the body to the middle portion of the first protrusion, the second tapered portion of the first protrusion increasing in width from the second section of the body to the middle portion of the first protrusion.

9. The rail joint bar of claim 8, wherein the middle portion of the first protrusion at the intermediate section of the body is a constant width.

10. The rail joint bar of claim 1, wherein the first protrusion is spaced from the top portion of the body.

11. The rail joint bar of claim 10, wherein the second protrusion defines a part of the bottom portion of the body.

12. The rail joint bar of claim 1, wherein the body is manufactured via a forging process.

13. A rail joint assembly comprising:

a first rail having a head portion, a web portion, and a base portion, the first rail having a first side and a second side;

a second rail having a head portion, a web portion, and a base portion, the second rail having a first side and a second side, an end of the first rail configured to abut an end of the second rail;

a first rail joint bar comprising a body having a first end, a second end positioned opposite from the first end, a first side, a second side positioned opposite from the first side, a top portion positioned between the first and second sides, and a bottom portion positioned between the first and second sides and positioned opposite from the top portion, the body having a first section adjacent to the first end of the body, a second section adjacent to the second end of the body, and an intermediate section positioned between the first section and the second section; and a second rail joint bar comprising a body having a first end, a second end positioned opposite from the first end, a first side, a second side positioned opposite from the first side, a top portion positioned between the first and second sides, and a bottom portion positioned between the first and second sides and positioned opposite from the top portion, the body having a first section adjacent to the first end of the body, a second section adjacent to the second end of the body, and an intermediate section positioned between the first section and the second section, wherein the second side of the body of the first and second rail joint bars each include a first protrusion and a second protrusion spaced from the first protrusion, the first and second protrusions each having a length defined by an axis extending from the first end of the body to the second end of the body, a width defined by an axis extending from the first side of the body to the second side of the body, and a height defined by an axis extending from the top portion to the bottom portion of the body, the width of the first protrusion at the intermediate section of the body is larger than the width of the first protrusion at the first and second sections of the body, wherein the length of each of the first and second protrusions extends from the first end of the body to the second end of the body, and wherein the first rail joint bar is configured to abut the first sides of the first and second rails with the intermediate section of the first rail joint bar overlapping the ends of the first and second rails in a direction extending along a longitudinal axis of the first and second rails and the second rail joint bar is configured to abut second sides of the first and second rails with the intermediate section of the second rail joint bar overlapping the ends of the first and second rails in a direction extending along a longitudinal axis of the first and second rails.

14. The rail joint assembly of claim 13, wherein the width of the second protrusion of the first and second rail joint bars at the intermediate section of each body is larger than the width of the second protrusion of the first and second rail joint bars at the first and second sections of each body.

15. The rail joint bar of claim 14, wherein the second protrusion of the first and second rail joint bars at the intermediate section of each body includes a first tapered portion, a middle portion, and a second tapered portion, the first tapered portion of each second protrusion increasing in width from the first section of each body to the middle portion of each second protrusion, the second tapered portion of each second protrusion increasing in width from the second section of each body to the middle portion of each second protrusion.

16. The rail joint assembly of claim 13, wherein the height of the first protrusion of the first and second rail joint bars at the intermediate section of each body is larger than the height of the first protrusion of the first and second rail joint bars at the first and second sections of each body.

17. The rail joint assembly of claim 16, wherein the height of the second protrusion of the first and second rail joint bars at the intermediate section of each body is larger than the height of the second protrusion of the first and second rail joint bars at the first and second sections of each body.

18. The rail joint assembly of claim 13, wherein the first protrusion of the first and second rail joint bars at the intermediate section of each body includes a first tapered portion, a middle portion, and a second tapered portion, the first tapered portion of each first protrusion increasing in width from the first section of each body to the middle portion of each first protrusion, the second tapered portion of each first protrusion of the first and second rail joint bars increasing in width from the second section of each body to the middle portion of each first protrusion.

19. The rail joint assembly of claim 13, further comprising a plurality of fasteners configured to secure the first and second rail joint bars to the first and second rails, wherein the body of the first and second rail joint bars each define a plurality of openings each configured to receive one of the plurality of fasteners.

20. The rail joint assembly of claim 13, further comprising a first insulator configured to be positioned between the first rail joint bar and the first and second rails and a second insulator configured to be positioned between the second rail joint bar and the first and second rails.

21. The rail joint assembly of claim 13, wherein the body of the first and second rail joint bars are each manufactured via a forging process.

22. A method of manufacturing a rail joint bar comprising:

providing a metal body having a first end, a second end positioned opposite from the first end, a first side, a second side positioned opposite from the first side, a top portion positioned between the first and second sides, and a bottom portion positioned between the first and second sides and positioned opposite from the top portion, the body having a first section adjacent to the first end of the body, a second section adjacent to the second end of the body, and an intermediate section positioned between the first section and the second section; and forming a first protrusion and a second protrusion spaced from the first protrusion on the second side of the body via a forging process, the first and second protrusions each having a length defined by an axis extending from the first end of the body to the second end of the body, a width defined by an axis extending from the first side of the body to the second side of the body, and a height defined by an axis extending from the top portion to the bottom portion of the body, the width of the first protrusion at the intermediate section of the body is larger than the width of the first protrusion at the first and second sections of the body, wherein the length of the first and second protrusions extends from the first end of the body to the second end of the body.

* * * * *